United States Patent [19]

Allen

[11] Patent Number: 4,550,912

[45] Date of Patent: Nov. 5, 1985

[54] SPHERICAL MAZE GAME APPARATUS

[76] Inventor: David L. Allen, 447 W. Sunset Cir., Mesa, Ariz. 85201

[21] Appl. No.: 551,420

[22] Filed: Nov. 14, 1983

[51] Int. Cl.[4] ..... A63B 67/14

[52] U.S. Cl. ..... 273/113; 273/115

[58] Field of Search ..... 273/109–116

[56] References Cited

U.S. PATENT DOCUMENTS

| | | | |
|---|---|---|---|
| 783,357 | 2/1905 | Bissell | 273/115 |
| 1,631,587 | 6/1927 | Gates | 273/116 |
| 3,827,694 | 8/1974 | Lemelson | 273/113 |
| 4,251,075 | 2/1981 | Jaworski | 273/113 |

*Primary Examiner*—Richard C. Pinkham
*Assistant Examiner*—Benjamin H. Layno
*Attorney, Agent, or Firm*—H. Gordon Shields

[57] ABSTRACT

Circular maze game apparatus includes a transparent sphere which encloses another sphere having a maze on its external periphery, with predetermined paths laid out throughout the maze between a predetermined starting point and a predetermined ending point. A rolling element, such as a marble, is disposed on the outer periphery of the inner sphere. The purpose of the game is to move the rolling element along the predetermined path from the starting point to the ending point through the maze by manipulating the game apparatus. At selected locations in the maze, and adjacent to the selected path, apertures extend into the center of the inner sphere so that if the rolling element strays away from the predetermined path, the rolling element may roll into the center of the sphere. In this instance the player must start over.

6 Claims, 5 Drawing Figures

SPHERICAL MAZE GAME APPARATUS

BACKGROUND OF THE INVENTION

1. Field of the Invention

This invention relates to maze games, and, more particularly, to a three-dimensional maze game in which the object is to move a rolling element along a preselected or predetermined path on the outer periphery of a sphere.

2. Description of the Prior Art

The employment of mazes for various kinds of games is old in the art. For example, there have been two-dimensional mazes in the prior art in which a rolling element, such as a marble, ball bearing, or the like, is used as a game piece to be moved along a predetermined path by movement of the two-dimensional maze, with the object being to cause the rolling element to avoid pitfalls, such as holes, blind alleys, or the like, in order to cause the rolling element to move from a predetermined beginning point to a predetermined finishing point.

The two-dimensional mazes discussed in the above paragraph have generally been of two types, one type being a two-dimensional maze held by hand and tiltable by a user, and another type being mounted on a type of mounting in which the two-dimensional maze may be tilted in two planes.

SUMMARY OF THE INVENTION

The invention described and claimed herein comprises a maze game in which a maze is disposed on the outer periphery of an inner sphere, and a clear or transparent sphere is disposed about the maze sphere. A rolling element is disposed on the surface of the inner maze sphere and is manually moved through the maze along a predetermined path. Pitfalls in the maze, in addition to blind or dead-end paths, include holes or apertures which allow the rolling element to fall into the interior of the sphere, thus requiring the user to start over again, and pins which extend radially outwardly in the path of the rolling element if a user inverts the double sphere game apparatus in order to circumvent the various pitfalls of the apparatus by causing the rolling element to move on the inner periphery of the outer, transparent, sphere.

Among the objects of the present invention are the following:

To provide new and useful game apparatus;

To provide new and useful game apparatus involving a rolling element;

To provide new and useful maze game apparatus;

To provide new and useful maze apparatus in which the maze is disposed on the outer periphery of a sphere; and To provide new and useful maze apparatus in which the maze is moved in three dimensions and in which the maze is disposed on a three-dimensional base element.

DESCRIPTION OF THE PREFERRED EMBODIMENT

Figure 1:
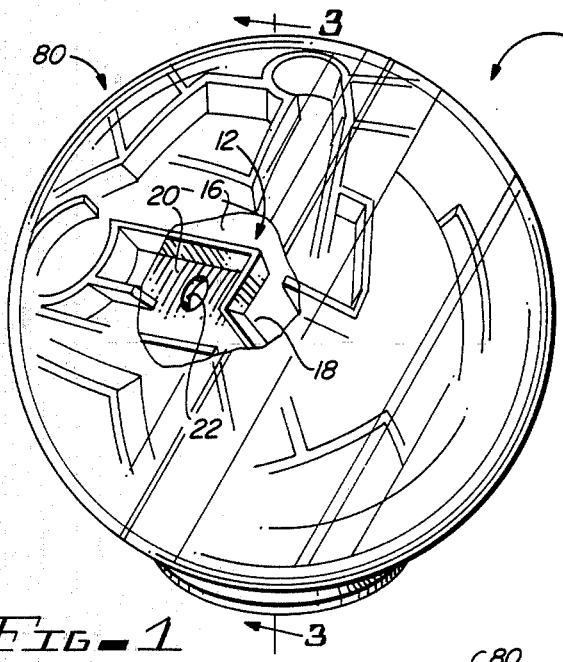
FIG. 1 is a top perspective view of the apparatus of the present invention.

FIG. 1 is a perspective view of three-dimensional maze game apparatus 10 which includes an inner sphere or base element 12 and an outer element or outer sphere 80 disposed concentrically about the inner sphere 12. The outer element or sphere 80 is transparent or clear so that the inner sphere or element 12 may be carefully observed at all times while playing the game apparatus 10. The two spherical elements 12 and 80 are secured together by a base 28.

Figure 2:
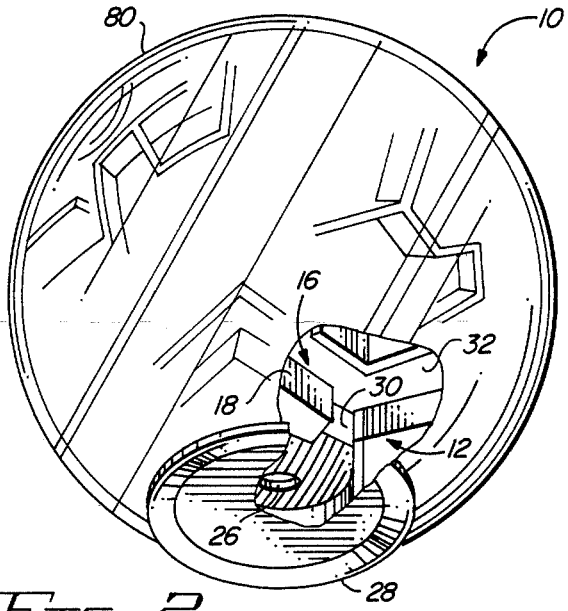
FIG. 2 is a bottom perspective view of the apparatus of the present invention with a portion cut away.
Figure 3:
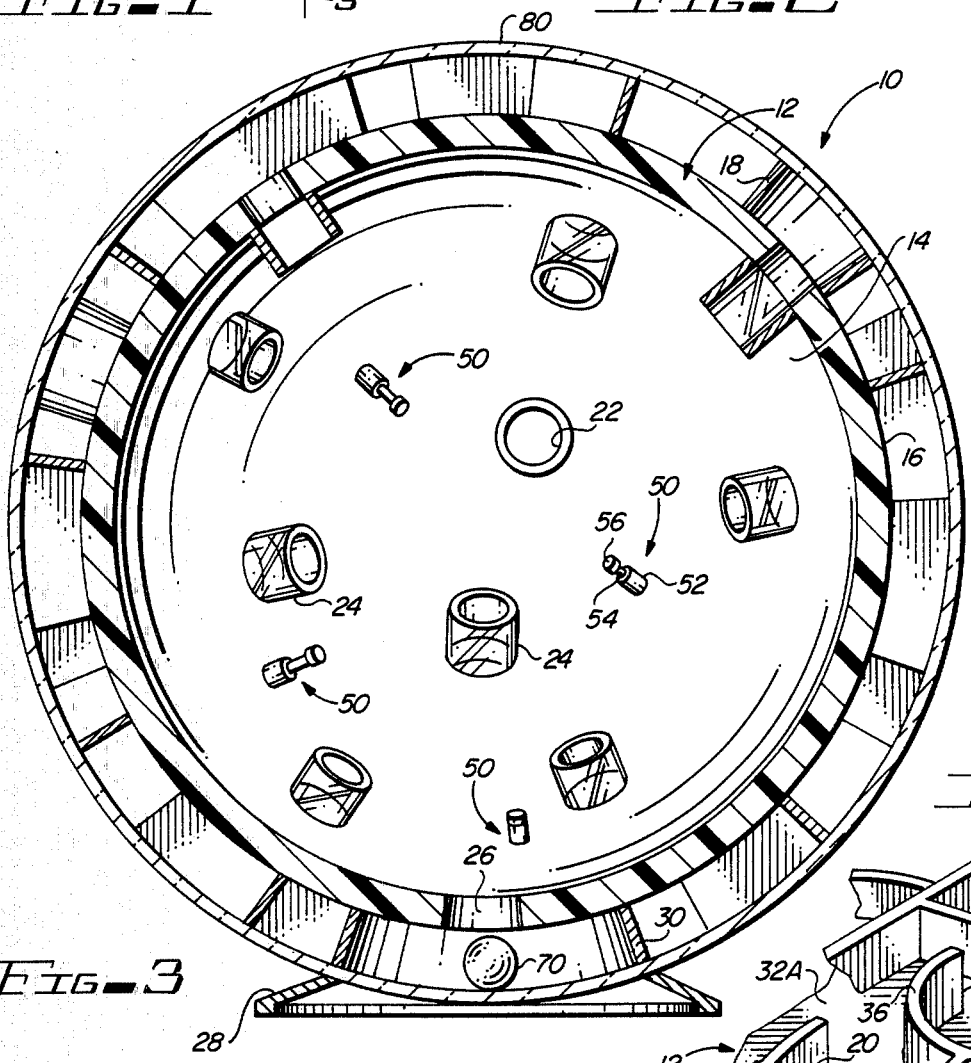
FIG. 3 is a view in partial section of the apparatus of FIG. 1, taken generally along line 3—3 of FIG. 1.
Figure 4:
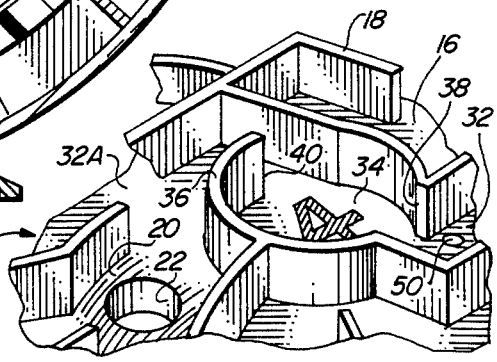
FIG. 4 is a perspective view of a portion of the apparatus of the present invention.

A portion of the outer element or sphere 80 is broken away in FIG. 1 to show more clearly some of the various features or elements of the apparatus 10. FIG. 2 is a bottom perspective view of the game apparatus 10, showing how both the inner sphere 12 and the outer sphere 80 are secured to the base 28. A portion of the inner and outer spheres 12 and 80, respectively, are shown broken away in FIG. 2 to further illustrate various features of the game apparatus 10. FIG. 3 is a view in partial section through the game apparatus 10, taken generally along line 3—3 of FIG. 1. FIG. 3 shows the apparatus 10 resting on the base 28. FIG. 4 is an enlarged fragmentary view of a portion of the inner sphere 12, illustrating various elements which are disposed on the inner sphere 12 and which extend between the inner sphere 12 and the outer sphere 80. For the following discussion, reference will primarily be made to FIGS. 1, 2, 3, and 4.

The apparatus 10 includes the base element or inner sphere 12 and an outer sphere or element 80, both of which are secured to a base 28. The base 28 supports the apparatus and defines a stand on which the apparatus 10 rests when it is not in use. The inner sphere 12 and the outer sphere 80 are concentric in arrangement, and accordingly are spaced apart a predetermined distance at all locations.

The base element or sphere 12 includes an inner peripheral surface or inner periphery 14 and an outer peripheral spherical surface or outer periphery 16. Disposed on the outer periphery 16 are a plurality of maze barriers 18. The maze barriers are located in such a fashion as to provide a general maze over substantially the entire outer periphery. The maze barriers 18 extend between the outer periphery 16 of the inner sphere 12 and the inner periphery of the outer sphere 80 so that a rolling element or ball 70, shown in FIG. 3, may easily roll between or within the maze barriers on the outer periphery 16 of the base element or inner sphere 12. The maze barriers define a plurality of paths on the outer periphery 16 of the inner sphere 12 between a predetermined starting point and a predetermined ending point. The maze barriers 18 are designed to provide only a single preferred or predetermined path from the beginning point of the game to the ending point of the game. However, there are a plurality of false paths 20 into which the rolling element or ball 70 may fall. The false paths 20 may lead nowhere or they may include apertures through which the rolling element or ball 70 may fall to the interior of the inner sphere 12 so that the player will have to begin the game over again.

In FIG. 1, a portion of the outer sphere 80 is broken away to show the outer periphery 16 of the inner sphere 12. A false path 20 is shown, with a plurality of maze barriers 18 extending outwardly from the outer periphery 16 of the inner sphere 12 to the outer element or sphere 80 to define the false path 20. The maze barriers 18 define various paths, including the false path 20. In the false path 20, there is an aperture 22 which extends through the base element or sphere 12. The ball 70, if it rolls along the false path 20, may fall through the aperture 22 and into the interior of the inner sphere 12.

The bottom of the apparatus 10 is a bottom or base aperture 26, shown both in FIGS. 2 and 3. For starting the game, the game apparatus 10 is held in the upright position until the ball 70 rolls through the aperture 26 and into the interior of the base 28. From the base 28, there is a beginning aperture or opening 30 that defines the starting or beginning point of the game through which the ball 70 rolls to the beginning of the maze and along a preferred or predetermined correct path 32. Hopefully, the manual skill or dexterity of the player will allow the player to rotate the game apparatus 10 so that the ball 70 will continue to follow the preferred path 32 and thus avoid the many false paths 20.

Along the preferred path 32 are a plurality of numbered pockets 34. A pocket 34 is shown in detail in FIG. 4. The pocket 34 shown in FIG. 4 is numbered "4". Along the preferred path there may be, for example, as many as ten or more pockets between the beginning of the game at the opening or beginning aperture 30, and the ending or end of the game. The preferred path 32 between pockets is preferably sequentially more difficult, to thus tax the manual skill or dexterity of the player.

In FIG. 4, the pocket 34 is defined by circular maze walls 36, which comprise a variation of the maze barriers 18. The pocket walls 36 are shown as circular in FIG. 4, but they may be rectangular, or any other configuration, as desired.

The pocket 34 includes an opening 38 in the walls 36 along the preferred path 32 through which the ball 70 rolls into the pocket 34. From the pocket 34, the preferred outward path 32A is approached through the opening 40 which extends also through the pocket walls 36.

Just out of the pocket 40, and along the preferred path 32A, there is another false path 20. An aperture 22 is shown disposed along the false path 20 extending through the base element or inner sphere 12. Thus, if the ball 70 does not move along the preferred path 32A, from the opening 40, but rather rolls into the false path 22, the ball 70 may roll through the aperture or opening 22 into the interior of the inner sphere 12, and the player will have to start the game over again.

On the interior of the base element or inner sphere 12, and disposed about the apertures 22, are cylinders 24. See FIG. 3. The purpose of the cylinders 24 is to prevent the element 70 from being rolled outwardly from the interior or inner periphery 14 of the inner sphere 12 through the holes or apertures 22 onto the outer periphery 16. Thus, the ball 70, once it rolls through an aperture 22, and through a cylinder 24, remains on the inner periphery 14 until it moves through the bottom aperture 26 and into the base 28. From the base 28, the ball 70 must then roll through the opening 30 at or to the beginning of the preferred path 32. The player must accordingly start at the beginning, at the opening 30, each time the sphere or element 70 falls through an opening or aperture 22 into the interior of the inner sphere 12.

Figure 5:
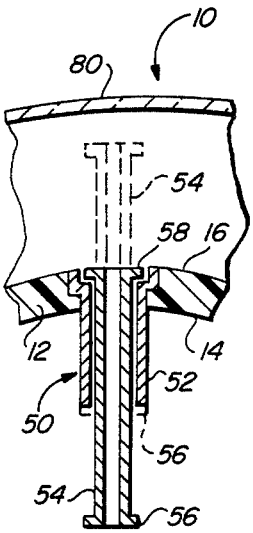
FIG. 5 is a view in partial section of another portion of the apparatus of the present invention.

It will be obvious that a way to avoid the openings or apertures 22 is to roll the element 70 not on the outer periphery 16 of the inner sphere 12, but on the inner periphery of the outer sphere 80. The player thus "cheats" or avoids the potential pitfalls of the false paths 20, the apertures 22, and the maze barriers 18 to thus have the ball 70 always travel along the preferred path 32 from pocket to pocket from the beginning point to the ending point of the game. In order to foil such action, there are a plurality of pin barriers 50 disposed along the preferred path 32. The pin barriers are best shown in FIG. 5. FIG. 5 comprises a view in partial section through a portion of the apparatus 10 and illustrates the construction and use of the pin barriers 50.

A pin barrier 50 includes a cylinder 52 which is disposed in the base element or inner sphere 12. The outer end of the cylinder 52 is flush with the outer periphery 16 of the inner sphere 12. The cylinder 52 is secured to the inner sphere 12.

Extending through the cylinder 52 is a pin 54. The pin 54 has a head 56 on one end of the pin and a head 58 on the other end of the pin so that it remains in the cylinder 52. The pin 54 moves in the cylinder between its closed or down position, as shown in FIG. 5, and its outer or open position, shown in phantom in FIG. 5. The pin 54 moves by gravity. The head 56 comprises a lower or bottom head and the head 58 comprises an upper or top head.

The head 56 is disposed against the bottom of the cylinder 52, as shown in phantom in FIG. 5, when the apparatus 10 is inverted. Inverting the apparatus 10 causes the pin 58 to move by gravity. The head 58 prevents the pin 54 from moving out of the cylinder 52 and into the interior of the inner sphere 12.

When the pin is in its down or closed position, as shown in FIG. 5, and also as shown in FIGS. 3 and 4, the upper head 58 is disposed within a counterbore or recess in the cylinder 52. The head 58 is thus also flush with the outer periphery 16 when the pin 54 is in its recessed or closed position.

As shown in FIG. 4, the pin barrier 50 is offset from the center of the preferred path 32. For convenience in allowing the ball 70 to roll smoothly over the outer periphery 16 of the inner sphere 12, the pin barriers 50 are preferably spaced slightly off the center of the preferred path 32. The width of the preferred path 32 is slightly greater than the diameter of the rolling element 70 and thus the rolling ball or element 70 moves smoothly along the preferred path. The pin barriers 50, though disposed off the center of the path, nevertheless close off the preferred path when the pin is in the open or out (dotted line, FIG. 5) position to prevent the ball 70 from rolling along the preferred path. This prevents a player from inverting the apparatus 10 and from then moving the ball 70 on the inner periphery of the transparent outer sphere 80.

The game apparatus 10 comprises a three-dimensional maze game, with a maze defined by a plurality of maze barrier walls 18 which extend between the outer periphery 16 of the inner sphere 12 and the inner periphery of the outer sphere 80. With a ball or rolling element 70 manually maneuvered by a user on the outer periphery 16, and supposedly along a preferred path 32, the player utilizes manual skill in maneuvering the apparatus 10 in three dimensions in the attempt to move the sphere along the preferred path 32 and without extending into false paths 20.

The false paths 20 are either blind, and thus extend nowhere, or else they have a hole or aperture 22 through which the ball 70 falls into the interior of the inner sphere. As long as the user or player exercises the proper degree of skill, the ball 70 remains on the preferred path 32 from pocket 34 to pocket. As indicated above, the preferred path portions 32 are more difficult between sequentially higher numbered pockets.

It will be understood that the apparatus 10 of the present invention defines a three-dimensional maze which necessitates the user to manually move the apparatus in three dimensions in order to maintain the rolling element along the desired path. Improper moves in any dimension may, and will usually, result in an interruption of the movement of the ball from the preferred path. Typically, straying from the preferred path 32 will result in the ball 70 falling through an aperture 22 into the interior of the inner sphere 12. This, in turn, necessitates the player starting over by moving the ball 70 into the base 28, and through the opening 30 back along the preferred path 32. Manual dexterity is required of a user or player in using the apparatus. The degree of manual dexterity required increases as the rolling element progresses through the maze, along the predetermined path.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Three dimensional maze apparatus, comprising, in combination:

first spherical means, including a first spherical surface having an outer periphery and an inner periphery, and maze barriers disposed on the first spherical surface defining a plurality of false paths and a single preferred path;

second spherical means disposed concentrically about and secured to the first spherical means and defining a transparent covering for the first spherical means and adapted to be held by a user to move the first spherical means in three dimensions to control the movement of the rolling element on the outer periphery of the first spherical means;

base means secured to both the first spherical means and the second spherical means and defining a stand for supporting the maze apparatus when it is not being used;

a rolling element disposed on the outer periphery and adapted to be moved on the outer periphery by a user moving the first spherical means in three dimensions to control the movement of the rolling element; and aperture means extending through the first spherical means for communicating between the outer periphery and the inner periphery, including a plurality of apertures spaced apart along the false paths through which the rolling element may fall into the interior of the first spherical means, including a base aperture through which the rolling element may fall into the base means from the first spherical means.

2. The apparatus of claim 1 in which the aperture means further includes a plurality of interior cylinders secured to the inner periphery and disposed about the plurality of apertures to prevent the rolling element from moving through the apertures to the outer periphery from the inner periphery.

3. The apparatus of claim 1 in which the base means includes a beginning aperture communicating with the preferred path on the outer periphery through which the rolling element moves to the preferred path from the base means.

4. The apparatus of claim 1 in which the second spherical means is spaced apart from the first spherical means, and the maze barriers extend between the first and second spherical means.

5. The apparatus of claim 1 in which the maze barrier of the first spherical means includes a plurality of pockets on the preferred path denoting progress along the preferred path.

6. The apparatus of claim 1 in which the first spherical means further includes a plurality of pin barriers disposed along the preferred path to prevent a user from inverting the apparatus and moving the rolling element on the second spherical means, each pin barrier including a cylinder secured to the first spherical means and extending inwardly into the interior thereof, and a pin movable in the cylinder by gravity from the interior of the first spherical means outwardly into the preferred path and towards the second spherical means to prevent movement of the rolling element along the preferred path on the second spherical means when the apparatus is inverted.

* * * * *